US005489502A

United States Patent [19]

Wada

[11] Patent Number: 5,489,502

[45] **Date of Patent: * Feb. 6, 1996**

[54] SILVER HALIDE PHOTOGRAPHIC LIGHT-SENSITIVE MATERIAL

[75] Inventor: Yasunori Wada, Hino, Japan

[73] Assignee: Konica Corporation, Tokyo, Japan

[ * ] Notice: The portion of the term of this patent subsequent to Feb. 28, 2012, has been disclaimed.

[21] Appl. No.: 198,500

[22] Filed: Feb. 18, 1994

[30] Foreign Application Priority Data

Feb. 23, 1993 [JP] Japan ..... 5-033491

[51] Int. Cl.[6] ..... G03C 1/035; G03C 1/76

[52] U.S. Cl. ..... 430/496; 430/533; 430/567

[58] Field of Search ..... 430/496, 533, 430/567

[56] References Cited

U.S. PATENT DOCUMENTS

| | | | |
|---|---|---|---|
| 5,225,319 | 7/1993 | Fukazawa et al. | 430/533 |
| 5,238,794 | 8/1993 | Hirose et al. | 430/496 |
| 5,254,446 | 10/1993 | Ikenoue et al. | 430/503 |
| 5,294,473 | 3/1994 | Kawamoto | 430/533 |
| 5,368,997 | 11/1994 | Kawamoto | 430/533 |
| 5,393,652 | 2/1995 | Marui | 430/533 |

FOREIGN PATENT DOCUMENTS

| | | |
|---|---|---|
| 0583787A2 | 2/1994 | European Pat. Off. . |
| 0588331A1 | 3/1994 | European Pat. Off. . |
| 0601501A1 | 6/1994 | European Pat. Off. . |
| 0607905A2 | 7/1994 | European Pat. Off. . |
| 0606070A1 | 7/1994 | European Pat. Off. . |

OTHER PUBLICATIONS

Database WPI Week 9019, Derwent Publications Ltd., London, GB; AN 90–14337 & JP–A–2 089 045 (Fuji Photo Film Co.) 29 Mar. 1990 * abstract *.

Database WIP Week 8643, Derwent Publications Ltd., London, GB; AN 86–281569 & JP–A–61 205 137 (Dia Foil KK) 11 Sep. 1986 * abstract *.

*Primary Examiner*—Janet C. Baxter

*Attorney, Agent, or Firm*—Frishauf, Holtz, Goodman, Langer & Chick

[57] ABSTRACT

A silver halide photographic light-sensitive emulsion is disclosed. The photographic material comprises a support and a silver halide emulsion layer provided on the support, and at least 30% of the total projection area of the silver halide grains contained in the silver halide emulsion layer is occupied by that of tabular silver halide grains having an aspect ratio of not less than 2; and the support comprises polyethylene-2,6-naphthalate and has a thickness of 70 μm to 120 μm. The photographic material is inhibited in the formation of roller mark in an automatic processor.

15 Claims, No Drawings

SILVER HALIDE PHOTOGRAPHIC LIGHT-SENSITIVE MATERIAL

FIELD OF THE INVENTION

The present invention relates to a silver halide photographic light-sensitive material of high sensitivity which has little pressure fogging and which has few roller marks even in hardening-free high temperature rapid processing.

BACKGROUND OF THE INVENTION

In the field of medical photographic light-sensitive materials, in particular, high sensitivity and high image quality are essential requirements of patient disease diagnosis.

It is known to use tabular silver halide grains to achieve high sensitivity and high image quality. Tabular grains offer advantages such as improved spectral sensitization efficiency and improved image granularity and sharpness, and are disclosed, for instance, in British Patent No. 2,112,157 and U.S. Pat. Nos. 4,439,520, 4,433,048, 4,414,310 and 4,434,226.

However, tabular silver halide grains are faulty that fogging is likely when they are compressed. As means of overcoming this drawback, some methods have been proposed in which silver halide grains are prepared to have a core of higher iodine content or to incorporate a latex. However, the former approach does not offer a perfect solution because of pressure desensitization, resulting in nothing more than a balance between mutually opposite features called pressure blackening and pressure desensitization. The latter approach has drawbacks such as deterioration of the driability of the light-sensitive material upon processing because of the increased amount of binder.

Also, methods of eliminating the hardening in the course of processing are disclosed in Japanese Patent Publication Open to Public Inspection (hereinafter referred to as Japanese Patent O.P.I. Publication) Nos. 111933/1983 and 206750/1988, in which tabular silver halide grains are used at a hydrophilic colloid layer swelling rate below 200%. In fact, the driability improves and the degree of hardening can be lowered when tabular grains are used at a hydrophilic colloid layer swelling rate of not higher than 200%. However, hardener-free processing results in an extremely increased number of roller marks, or roller pressure traces occurring in the developer, so that no satisfactory results are obtained solely by reducing the light-sensitive material swelling rate below 200%.

SUMMARY OF THE INVENTION

The object of the present invention is to provide a silver halide photographic light-sensitive material of high sensitivity, high image quality and improved pressure resistance which has no roller marks even when processed with a hardener-free developer.

The above-described object of the invention is accomplished by a silver halide photographic light-sensitive material comprising a support and a silver halide emulsion layer provided on the support in which at least 30% of the total projection area of the silver halide grains contained in the silver halide emulsion layer is occupied by the projection area of tabular silver halide grains having an aspect ratio of not less than 2; and the support comprises polyethylene-2, 6-naphthalate and has a thickness of 70 μm to 120 μm.

DETAILED DESCRIPTION OF THE INVENTION

The average grain size of the tabular silver halide grains relating to the present invention is preferably 0.3 to 3.0 μm, more preferably 0.5 to 1.5 μm.

The average value, average aspect ratio, of grain diameter/thickness, aspect ratio, of the tabular silver halide grains of the present invention is normally not less than 2.0, preferably 2.5 to 20.0, more preferably 3 to 10.0.

The average thickness of the tabular silver halide grains of the present invention is preferably 0.01 μm to 0.5 μm, more preferably 0.04 μm to 0.3 μm.

In the present invention, the diameter of a silver halide grain is defined as the diameter of a circle having the same area as the projected area of the grain as observed on an electron micrograph of the grain.

In the present invention, the thickness of a silver halide grain is defined as the least distance between two parallel planes constituting the tabular silver halide grain.

The thickness of a tabular silver halide grain can be obtained from an electron micrograph shadowed with the silver halide grain or an electron micrograph of a sampled cross-section of the silver halide grain in an emulsion coated and dried on the support.

To obtain the average aspect ratio, at least 100 grains are sampled. With respect to the silver halide emulsion of the present invention, the effect of the invention is obtained when tabular silver halide grains account for not less than 30% of all light-sensitive silver halide grains, and the effect is enhanced when the ratio of tabular silver halide grains is not less than 50%.

The emulsion for the present invention may be a single emulsion or a mixture of two or more emulsions. When used in the form of a mixture, the emulsion of the present invention may be combined with the same kind of emulsion or with grains of normal crystal habit or twin grains having an aspect ratio of less than 2.

The silver halide photographic light-sensitive material of the present invention may be configured with a single emulsion layer or a number of emulsion layers. Even in the case of a multiple-layer structure, the desired effect of the invention is obtained, as long as grains having an aspect ratio of not lower than 2 occupy not less than 30% of the total projection area of all light-sensitive silver halide grains.

The tabular silver halide emulsion of the present invention is preferably a monodispersed emulsion, with greater preference given to a tabular silver halide emulsion wherein silver halide grains whose variation coefficient of grain size distribution ($\sigma/\bar{r}$) of 0.2 or less. In the above $\sigma$ is the standard deviation of grain size distribution and $\bar{r}$ is the average grain size.

The tabular silver halide emulsion of the present invention may have any halogen composition such as silver chloride, silver bromide, silver chlorobromide, silver iodobromide and silver chloroiodobromide. From the viewpoint of high sensitivity, silver bromide or silver iodobromide is preferred, the average silver iodide content being 0 to 5.0 mol %, preferably 0.1 to 3.0 mol %.

The tabular silver halide grains of the present invention may have a halogen composition uniform therein or localized silver iodide, with preference given to a halogen composition wherein silver iodide is localized in the core.

A tabular silver halide emulsion can be produced in accordance with Japanese Patent O.P.I. Publication Nos.

113926/1983, 113927/1983, 113934/1983 and 1855/1987 and European Patent Nos. 219,849 and 219,850. A monodispersed tabular silver halide emulsion can be produced in accordance with Japanese Patent O.P.I. Publication No. 6643/1986.

A tabular silver iodobromide emulsion having a high aspect ratio can be produced by adding an aqueous solution of silver nitrate to a gelatin solution containing a halide or simultaneously adding both an aqueous solution of silver nitrate and an aqueous solution of a halide to an aqueous solution of gelatin being kept at a pBr of not more than 2, to form a seed crystal, and growing the seed crystal by adding a silver nitrate solution and a halide solution by the double jet method.

The size of tabular silver halide grains can be controlled by temperature and rates of addition of the aqueous solutions of silver salt and halide during grain formation. The aspect ratio can be controlled by method of seed crystal preparation, thickness of seed crystal, grain growing pAg and pH, halide composition, ripening time, temperature and other factors.

The average silver iodide content of a tabular silver halide emulsion can be controlled by changing the composition of the aqueous halide solution added, i.e., the ratio of the bromide and iodide.

In producing tabular silver halide grains, a silver halide solvent such as ammonia, thioether or thiourea can be used as necessary. For grain growth, the halogen and silver may be supplied as fine grains of silver halide, though they may be supplied in an aqueous solution containing silver ions and an aqueous solution containing halogen ions. In such case, silver iodide, silver iodobromide, silver bromide, silver chlorobromide, silver chloride, a solution containing halogen ions and a solution containing silver ions may be combined.

For the silver halide emulsion relating to the present invention, core/shell grains or double-structure grains, wherein the silver halide composition varies between the core and surface. Methods of core/shell emulsion production are described in detail in U.S. Pat. Nos. 3,505,068 and 4,444,877, British Patent No. 1,027,146 and Japanese Patent O.P.I. Publication No. 14331/1985. The core/shell grain is herein defined as a grain wherein the silver iodide content of the outermost layer is less than 5 mol %, preferably less than 3 mol %.

The silver iodide content of the outermost layer of a silver halide grain can be determined by various methods of surface elemental analysis. It is advantageous to use such methods as XPS (X-ray photoelectron spectroscopy), Auger electron spectroscopy and ISS. The silver iodide content of the outermost layer of the present invention is defined on the basis of measurements obtained by XPS, the simplest method of high precision.

Maximum thickness analyzable by the XPS surface analysis method is about 10 Å. For the principles of the XPS method for iodine content analysis near the silver halide grain surface, see "Denshino Bunko" (spectroscopy of electron), Jyunichi Aihara et al., Kyoritsu Library 16, published by Kyoritsu Shuppan, 1978.

The above-described emulsion may be of any of the surface latent image type, wherein latent images are formed on the grain surface, the internal latent image type, wherein latent images are formed inside the grain, and the type wherein latent images are formed in and on the grain. These emulsions permit the use of cadmium salt, lead salt, zinc salt, thallium salt, ruthenium salt, osmium salt, iridium salt or complex thereof, rhodium salt or complex salt, or the like, at the stage of physical ripening or grain preparation.

To remove soluble salts, the emulsion may be washed by noodle washing, flocculation precipitation or the like. Preferred washing methods for desalinization include the method described in Japanese Patent Examined Publication No. 16086/1960, which uses an aromatic hydrocarbon series aldehyde resin containing the sulfo group, and the method described in Japanese Patent O.P.I. Publication No. 158644/1988, which uses example polymeric flocculants G3 and G8.

Chemical sensitization can be achieved by sulfur sensitization, sensitization with Se compounds, sensitization with Te compounds, gold sensitization, sensitization with noble metals in group VIII of the periodic table of elements, e.g., Pd, Pt, Id, and combinations thereof. The combination of gold sensitization and sulfur sensitization and the combination of gold sensitization and sensitization with Se compounds are preferred. It is also preferable to use reduction sensitization in combination with chemical sensitization.

From the viewpoint of sensitivity and dye adsorption, it is preferable to supply iodine ions during or upon completion of chemical sensitization, in the form of silver iodide grains, in particular.

It is also preferable to carry out chemical sensitization in the presence of a compound adsorbable to silver halide.

For this purpose, preference is given to compounds having the mercapto group or the benzene ring, such as azoles, diazoles, triazoles, tetrazoles, indazoles, thiazoles, pyrimidines and azaindenes.

With respect to the silver halide photographic light-sensitive material relating to the present invention, the silver halide emulsion may be reduced for reduction sensitization by, for example, the addition of a reducing compound, silver ripening, wherein the emulsion is subjected to a condition involving excess silver ions at pAg of 1 to 7, and high-pH ripening, wherein the emulsion is subjected to a high pH condition at pH 8 to 11. These methods may be used in combination.

The reducing compound addition method is preferred, since the degree of reduction sensitization can be precisely adjusted. The reducing compound may be an organic or inorganic compound, exemplified by thiourea dioxide, stannous salts, amines, polyamines, hydrazine derivatives, formamidinesulfinic acid, silane compounds, borane compounds, ascorbic acid and derivatives thereof and sulfites, with greater preference given to thiourea dioxide, stannous chloride and dimethylamineborane. The appropriate range of the amount of these reducing compounds added is from $1\times10^{-8}$ to $1\times10^{-2}$ mol per mol of silver halide, though the amount varies depending on the reductivity of the compound, kind of silver halide, dissolution conditions and other factors. These reducing compounds are added in solution in an organic solvent such as water or alcohol during silver halide grain growth.

It is also preferable to reduce an optional portion and/or layer of the silver halide grain other than the outermost layer and further grow the grain. From the viewpoint of effect control, it is preferable that such reduction be performed on the inner core surface for multiple-layer lamination, e.g., the seed emulsion grain surface or the core surface when grains are not being grown. This reducing treatment may be performed in the presence of a thiosulfonic acid compound as disclosed in Japanese Patent O.P.I. Publication No. 135439/1990 and 136852/1990.

The silver halide photographic light-sensitive material of the invention may be optically sensitized with methine and other spectral sensitizing dyes, including cyanine dyes, merocyanine dyes, complex cyanine dyes, complex merocyanine dyes, holopolar dyes, hemicyanine dyes, styryl dyes and hemioxonol dyes. Especially useful dyes are cyanine dyes, merocyanine dyes and complex merocyanine dyes.

These spectral sensitizing dyes can have any heterocyclic ring nucleus which is generally used for dyes. Examples of such nuclei include the pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nuclei resulting from condensation of these nuclei with an aliphatic hydrocarbon ring, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may be substituted for on a carbon atom.

The merocyanine dye or complex merocyanine dye may have a 5- or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These dyes are described in German Patent No. 929,080, U.S. Pat. Nos. 2,231,658, 2,493,748, 2,503,778, 2,519,001, 2,912,329, 3,855,394, 3,656,959, 3,672,897 and 3,649,217, British Patent No. 1,242,588 and Japanese Patent Examined Publication No. 14030/1969.

These sensitizing dyes may be used singly or in combination.

Sensitizing dyes are often used in combination. Typical combinations are described in U.S. Pat. Nos. 2,688,545, 2,977,299, 3,397,060, 3,522,052, 3,527,641, 3,617,293, 3,628,964, 3,666,480, 3,679,428, 3,703,377 and 3,837,862, British Patent No. 1,344,281 and Japanese Patent Examined Publication No. 4936/1968.

Sensitizing dyes may be added at any optionally chosen time during grain formation by coating, before, during and after chemical sensitization, and may be preferably added at a number of time points.

The light-sensitive material of the present invention may have a crossover cut layer between the support and the emulsion layer. The crossover cut layer may be a subbing layer between the support and the hydrophilic colloid layer. A dye layer may be formed between the subbing layer and the emulsion layer. Dyes used in the subbing layer include oxonol dyes having the pyrazolone nucleus or barbituric acid nucleus, azo dyes, azomethine dyes, anthraquinone dyes, allylidene dyes, styryl dyes, triarylmethane dyes, merocyanine dyes and cyanine dyes.

The dye used in the dye layer may be dispersed in the form of fine particles.

Dyes which can be used for this purpose include Example Compounds 2, 4, 6, 8, 9, 10, 11, 12, 13–27, –2, 5, 6, –3, 4, 6, 8, 9, 10, 11, 12, 14–28, –3, 5, 6, 8, 10–16, –3, 5, 6, 7 described on pages 6 through 12 of Japanese Patent O.P.I. Publication No. 264247/1990.

These dyes can easily be synthesized in accordance with International Patent Publication No. 88/04794, European Patent Nos. 027423A1, 276,566 and 299,435, Japanese Patent O.P.I. Publication Nos. 92716/1977, 155350/1980, 155351/1980, 205934/1986 and 68623/1973, U.S. Pat. Nos. 2,527,583, 3,486,897, 3,746,539, 3,933,798, 4,130,429 and 4,040,841.

Although gelatin can be used as a hydrophilic colloid or binder in the light-sensitive material of the present invention, non-gelatin hydrophilic colloids may also be used.

Such non-gelatin hydrophilic colloids include gelatin derivatives, graft polymers of gelatin and other polymers, proteins such as albumin and casein, cellulose derivatives such as hydroxyethyl cellulose, carboxymethyl cellulose and cellulose sulfates, sugar derivatives such as sodium alginate, dextran and starch derivatives, and various synthetic hydrophilic homopolymers or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole. It is particularly preferable to use a dextran or polyacrylamide having a weight average molecular weight from 5000 to 100000 in combination with gelatin. Examples of such case are disclosed in Japanese Patent O.P.I. Publication No. 307738/1989, 62532/1990, 24748/1990, 44445/1990, 66031/1989, 65540/1989, 101841/1988 and 153538/1988.

Gelatins include limed gelatin, acid-processed gelatin, enzyme-processed gelatin as described on page 30 of Bull. Soc. Sci. Phot., Japan, No. 16 (1966), and gelatin derivatives obtained by reacting gelatin with various compounds such as acid halides, acid anhydrides, isocyanates, bromoacetic acid, alkanesultones, vinylsulfonamides, maleinimide compounds, polyalkylene oxides and epoxy compounds.

Polyethylene-2,6-naphthalate, the support for the silver halide photographic light-sensitive material of the present invention, is described below.

The polyethylene-2,6-naphthalate mentioned herein is a polymer substantially consisting of ethylene-2,6-naphthalate units, but may be an ethylene-2,6-naphthalate polymer modified with a small amount, e.g., not more than 10 mol %, preferably not more tan 5 mol % of a third component.

Polyethylene-2,6-naphthalate is usually produced by condensing naphthalene-2,6-dicarboxylic acid or a functional derivative thereof such as methyl naphthalene-2,6-dicarboxylate, and ethylene glycol under appropriate reaction conditions in the presence of a catalyst. The third component is exemplified by dicarboxylic acids such as adipic acid, oxalic acid, isophthalic acid, terephthalic acid, naphthalene-2,7-dicarboxylic acid and diphenyl ether dicarboxylic acid or lower alkyl esters thereof, dicarboxylic acids such as p-oxybenzoic acid and p-ethoxybenzoic acid or lower alkyl esters thereof, dihydric alcohols such as propylene glycol, trimethylene glycol, tetramethylene glycol, pentamethylene glycol, hexamethylene glycol and diethylene glycol, and polyalkylene glycols such as polyethylene glycol and polytetramethylene glycol.

This polymerization may be carried out in the presence of lubricants such as titanium dioxide, stabilizers such as phosphoric acid, phosphatic acid and esters thereof, antioxidants such as hindered phenol, polymerization regulators and plasticizers.

Preferably, the polyethylene naphthalate for the present invention has a intrinsic viscosity number of not lower than 0.4, preferably 0.40 to 0.65. The intrinsic viscosity number can be measured by a Ubbelohde's viscometer. The degree of crystallinity is preferably not lower than 35% and not higher than 60% for obtaining good physical property after film forming. The crystallinity degree is measured by a density-gradient-column method and defined according to the following equation:

Crystallinity degree$=(\rho_{(100)}-\rho/\rho_{(100)}-\rho_{(0)})\times 100\%$ in the above, $\rho$=Density of the material measured $\rho_{(100)}$=Density of the material in a perfect crystal form $\rho_{(0)}$=Density of the material in an amorphous form The support of the invention of polyethylene-2,6-naphthalate film can be prepared by a known method. The film may be stretched lengthwise and widthwise simultaneously or successively, and the stretching may be performed by 2 steps or more to each direction of length and width.

In the present invention, the thickness of the support comprised of polyethylene-2,6-naphthalate is 70 to 120 μm. The formation of scrach marks and roller marks in the light-sensitive material using tabular silver halide grains with a high aspect ratio of 2 or more are prevented by the use of the above polyethylene-2,6-naphthalate film having a thickness within the above range.

Since the commercial value of the polyethylene-2,6-naphthalate film of the present invention decreases when dust adheres thereto upon use, its surface resistivity is preferably not higher than 1014 Ω·cm. To obtain such a film, various methods are used as appropriate, including the method in which an antistatic agent is coated, the method in which a thin layer of a metal or metal compound is formed on the film surface, the method in which an antistatic agent is added at polymerization of the starting materials for polyester, and the method in which the starting materials for polyester and an antistatic agent are mixed at film preparation. It is also acceptable to use polyethylene-2,6-naphthalene as obtained by polymerization condensation of the starting materials sodium alkylbenzenesulfonate and polyalkylene glycol.

The support surface may be subjected, for example, to subbing, corona discharge, ultraviolet irradiation to facilitate coating layer adhesion.

The silver halide emulsion relating to the present invention may incorporate various photographic additives added before or after physical ripening or chemical ripening. Such additives include those described in Research Disclosure Nos. 17643 (December 1978), 18716 (November 1979) and 308119 (December 1989) (hereinafter referred to as RD17643, RD18716 and RD308119, respectively). The following table shows where the additives are described.

| | RD17643 | | RD18716 | | RD308119 | |
|---|---|---|---|---|---|---|
| Additive | Page | Category | Page | Category | Page | Category |
| Chemical sensitizer | 23 | III | 648 upper right | | 996 | III |
| Sensitizing dye | 23 | IV | 648–649 | | 996–998 | IV |
| Desensitizing dye | 23 | IV | | | 998 | B |
| Dye | 25–26 | VIII | 649–650 | | 1003 | VIII |
| Developing accelerator | 29 | XXI | 648 upper right | | | |
| Antifogging agent/ stabilizer | 24 | IV | 649 upper right | | 1006–1007 | VI |
| Brightening agent | 24 | V | | | 998 | V |
| Hardener | 26 | X | 651 left | | 1004–1005 | X |
| Surfactant | 26–27 | XI | 650 right | | 1005–1006 | XI |
| Antistatic agent | 27 | XII | 650 right | | 1006–1007 | XIII |
| Plasticizer | 27 | XII | 650 right | | 1006 | XII |
| Lubricant | 27 | XII | | | | |
| Matting agent | 28 | XVI | 650 right | | 1008–1009 | XVI |
| Binder | 26 | XXII | | | 1003–1004 | IX |

EXAMPLES

Example 1

Preparation of support

After an ester exchanging reaction catalyst was added to 100 parts of dimethyl naphthalene-2,6-dicarboxylate and 60 parts of ethylene glycol, 1.2 parts of sodium dodecylbenzenesulfonate, 0.8 parts of polyethylene glycol having a molecular weight of 8000 and 0.01 part of thyroid were added, followed by polymerization condensation. Thus obtained polymer has a intrinsic viscosity number of 0.50 and a crystallinity degree of 45%. The resulting polyethylene-2,6-naphthalate was fused and extruded and 3 fold stretched at 140° C. and then transversely 3 fold stretched at 155° C.

A 255° C. temperature was maintained for 10 seconds. A 100 μm film was thus obtained.

Supports of 70 μm, 120 μm and 180 μm thickness were prepared at different degrees of elongation.

Subbing

Each support was subbed in the same manner as for sample No. 9 in Example 1 of Japanese Patent O.P.I. Publication No. 104913/1977.

Preparation of emulsions A through C

Preparation of seed emulsion

While maintaining a temperature of 60° C., a pAg of 8 and a pH of 2.0, monodispersed cubic grains of silver iodobromide having an average grain size of 0.3 μm and a silver iodide content of 2 mol % were prepared by the double jet method. The resulting reaction mixture was desalinized at 40° C., using an aqueous solution of Demol-N (produced by Kao Atlas) and an aqueous solution of magnesium sulfate, after which it was redispersed in an aqueous gelatin solution, to yield a seed emulsion.

Grain growth from seed emulsion

Using the above seed emulsion, grains were grown as follows: First, the seed emulsion was dispersed in an aqueous gelatin solution being kept at 40° C., and aqueous ammonia and acetic acid were added to obtain a pH of 9.7. An aqueous solution of ammoniacal silver nitrate and an aqueous solution of potassium bromide and potassium iodide were then added to the dispersion by the double jet method, while maintaining a pAg of 7.3 and a pH of 9.7, to yield a layer containing 35 mol % silver iodide. Next, another aqueous solution of ammoniacal silver nitrate and an aqueous solution of potassium bromide were added by the double jet method. Until 95% of the desired grain size was reached, the pAg was kept at 9.0, the pH being varied continuously over the range from 9.0 to 8.0.

The pAg was then changed to 11.0, and while keeping the pH at 8.0, grains were grown until the desired grain size was obtained. Subsequently, acetic acid was added to obtain a pH of 6.0, and the silver electrode potential was adjusted to 25 mV of $E_{Ag}$ using an aqueous solution of potassium bromide. Then the anhydride of 5,5'-dichloro-9-ethyl-3,3'-di-(3-sulfopropyl)-oxacarbocyanine sodium salt (dye A) and the anhydride of 5,5'-di-(butoxycarbonyl)-1,1'-diethyl-3,3'-di-(4-sulfobutyl)-benzimidazolocarbocyanine sodium salt (dye B), at 300 mg and 15 mg per mol of silver halide, respectively, were added as spectral sensitizing dyes.

Next, to remove the excess salts by precipitation, the mixture was desalinized with the above aqueous solution of Demol-N and aqueous solution of magnesium sulfate, and then stirred and re-dispersed in an aqueous solution containing 92.2 g of ossein gelatin.

Monodispersed silver iodobromide emulsions A, B and C, comprising tetradecahedral grains with round tips having an average silver iodide content of 2.0 mol %, were thus prepared, which had average grain sizes of 0.40 μm, 0.65 μm and 1.00 μm and coefficients of variance of grain size ($\delta/\bar{r}$) of 0.17, 0.16 and 0.16, respectively, and aspect ratios of these emulsions, are all 1.0. In the above, δ is the standard deviation of grain size distribution and i is the average grain size of the emulsion.

Preparation of emulsions D through F

Preparation of spherical seed emulsion

A monodispersed spherical seed emulsion was prepared by the method of Japanese Patent O.P.I. Publication No. 6643/1986.

| Solution A | |
|---|---|
| Ossein gelatin | 150 g |
| Potassium bromide | 53.1 g |
| Potassium iodide | 24 g |

Water was added to make a total quantity of 7.2 1.

| Solution B | |
|---|---|
| Silver nitrate | 15000 g |

Water was added to make a total quantity of 6 1.

| Solution C | |
|---|---|
| Potassium bromide | 1327 g |
| 1-phenyl-5-mercaptotetrazole (dissolved in methanol) | 1.2 g |

Water was added to make a total quantity of 3 1.

| Solution D | |
|---|---|
| Aqueous ammonia (28%) | 705 ml |

To solution A being vigorously stirred at 40° C., solutions B and C were added by the double jet method over a period of 30 seconds, whereby nuclei were formed. During this operation, pBr was kept between 1.09 and 1.15.

1 minutes and 30 seconds later solution D was added over a period of 20 seconds, followed by ripening for 5 minutes at a KBr concentration of 0.071 mol/l and an ammonia concentration of 0.63 mol/l.

Then the seed emulsion was adjusted to pH 6.0 and immediately desalinized and washed. Electron microscopy identified this seed emulsion as a monodispersed spherical emulsion having an average grain size of 0.26 μm and a distribution width or $\delta/\bar{r}$ value of 18%.

Preparation of grown emulsion

The resulting spherical seed emulsion, at 0.14 mol per mol of the silver in the desired grown emulsion, was dissolved and dispersed in a 65° C. aqueous solution of gelatin containing polypropyleneoxy-polyethyleneoxy-disuccinate sodium salt, after which dimethylamineborane was added to a concentration of $1\times10^{-5}$ mol per mol of the silver in the finished silver halide emulsion. Subsequently, a silver nitrate solution, adjusted to a final average silver iodide content of 0.50 mol %, and a halide solution of potassium bromide and potassium iodide were added by the controlled double jet method over a period of 43 minutes, while maintaining a pH of 2.0, a pAg of 8.0 and a temperature of 65° C.

In this operation, the silver potential was adjusted to +b 25mV using an aqueous solution of potassium bromide. Then the above-mentioned dyes A and B, at 300 mg and 15 mg per mol of silver halide, respectively, were added as spectral sensitizing dyes.

Next, to remove the excess salts by precipitation, the mixture was desalinized with the above aqueous solution of Demol-N and aqueous solution of magnesium sulfate, and then stirred and re-dispersed in an aqueous solution containing 92.2 g of ossein gelatin. Emulsion D, comprising tabular silver iodobromide grains having an average grain size of 1.22 μm, an average thickness of 0.29 μm and an aspect ratio of 4.2, was thus obtained. Emulsions E through G, having aspect ratios of 2.5, 7.2 and 12 and average grain sizes of 0.75, 2.2 and 3.6 μm, respectively, were obtained in the same manner as above, except that grain growing pAg and pH were changed as appropriate.

To each of the obtained emulsions A through G, the above-mentioned spectral sensitizing dyes A and B, at 300 mg and 15 mg per mol of silver halide, respectively, were added at 55° C.

Ten minutes later, appropriate amounts of chloroauric acid, sodium thiosulfate and ammonium thiocyanate were added for chemical sensitization. Fifteen minutes before completion of ripening, silver iodide grains having average grain size of 0.05 μm and containing 0.8 mmol of potassium iodide per mol of silver halide was added. Subsequently, 4-hydroxy-6-methyl-1,3,3a,7-tetrazaindene was added at $3\times10^{-2}$ mol per mol of silver halide, and this mixture was dispersed in an aqueous solution of 70 g of gelatin.

After completion of the chemical ripening, emulsions A, B and C were mixed in a 1:6:3 ratio to yield emulsion H, and emulsions A, D and C were mixed in a 1:6:3 ratio to yield emulsion I.

To each emulsion, the following additives were added to yield an emulsion layer coating solution. At the same time the following protective layer coating solution was prepared. These emulsions were simultaneously coated on both faces of the support using two slide hopper type coaters at a speed of 80 m per minute so that the amount of silver coated would be 1.9 g/m$^2$ per face, the amount of gelatin coated would be 2.0 g/m$^2$ for the emulsion layers, and the amount of gelatin coated would be 1.1 g/m$^2$ for the protective layer, followed by drying for 2 minutes 20 seconds, to yield a sample. The sample was adjusted to 190% swelling rate (determined by the measuring method described in Japanese Patent O.P.I. Publication No. 206750/1988) by controlling the amount of hardener. In the above-mentioned manner, samples 1–14 were prepared in which emulsions and support were changed as given in the later-given table. As the support, the foregoing polyethylene-2,6-naphthalate (PEN) film of the invention, and a polyethyleneterephthalate film of 100 μm thick for comparison were used.

The additives used in the emulsions are as follows: The amounts of addition are shown per mol of silver halide.

| | |
|---|---|
| 1,1-dimethylol-1-bromo-1-nitromethane | 70 mg |
| t-butylcatechol | 400 mg |
| Polyvinylpyrrolidone (molecular weight 10,000) | 1.0 g |
| Styrene-maleic anhydride copolymer | 2.5 g |
| Nitrophenyl-triphenylphosphonium chloride | 50 mg |
| Ammonium 1,3-dihydroxybenzene-4-sulfonate | 2 g |
| Sodium 2-mercaptobenzimidazole-5-sulfonate | 1.5 g |

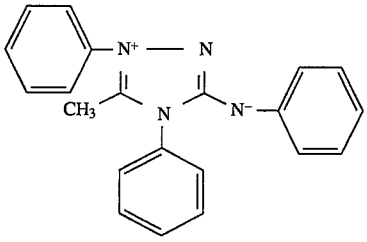

150 mg

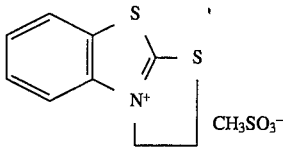

30 mg $C_4H_9OCH_2CH(OH)CH_2N(CH_2COOH)_2$ 1 g 1-phenyl-5-mercaptotetrazole 15 mg Protective layer coating solution A protective layer coating solution was prepared as follows: Figures for the amount of addition are shown per liter of coating solution.

| | |
|---|---|
| Limed inert gelatin | 68 g |
| Acid-processed gelatin | 2 g |
| Sodium isoamyl-n-decylsulfosuccinate | 1 g |
| Polymethyl methacrylate (matting agent of area-average grain size of 3.5 μm) | 1.1 g |
| Silicon dioxide grains (matting agent of area-average grain size of 1.2 μm) | 0.5 g |
| Ludox AM (colloidal silica, produced by Du Pont) | 30 g |
| Hardener $(CH_2{=}CHSO_2CH_2)_{20}$ | 500 mg |
| $C_4F_9SO_3K$ | 2 mg |
| $C_{12}H_{25}CONH(CH_2CH_{20})_5H$ | 2.0 g |

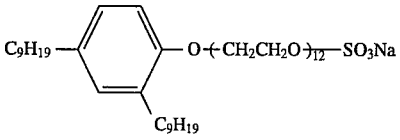

12 mg

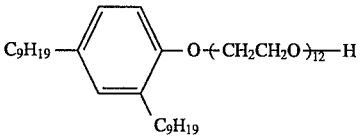

2 mg

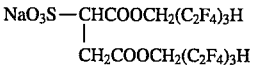

5 mg

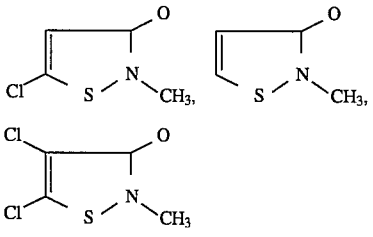

0.73 mg (50:46:4)

$F_{19}C_9O(CH_2CH_2O)_{10}CH_2CH_2OH$ 3 mg

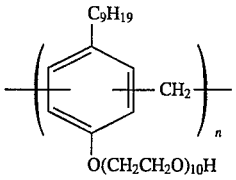

15 mg (mixture wherein n ranges from 2 to 5)

Preparation of processing solutions

Developer

| Part A | |
|---|---|
| Potassium hydroxide | 1140 g |
| Potassium sulfite | 2451 g |
| Sodium hydrogen carbonate | 380 g |
| Boric acid | 38 g |
| Diethylene glycol | 418 g |
| Pentasodium ethylenetriaminepentaacetate | 61 g |
| 5-methylbenzotriazole | 1.9 g |
| Hydroquinone | 1064 g |
| Water was added to make a total quantity of 9.3 l. | |
| **Part B (for 38 l finish)** | |
| Glacial acetic acid | 562 g |
| Triethylene glycol | 418 g |
| 1-phenyl-3-pyrazolidone | 100 g |
| 5-nitroindazole | 9.5 g |

Part mixing

While stirring 20 l of water at 25° C. in a 50 liter tank, the above parts A and B were added in this order, and finally water was added to make a total quantity of 38 l. This solution was kept standing at 25° C. for 24 hours, after which it was adjusted to pH 10.53 at 25° C. by addition of potassium hydroxide or acetic acid.

| Starter | |
|---|---|
| Glacial acetic acid | 230 g |
| Potassium bromide | 200 g |

Water was added to make a total quantity of 1.5 l.

The above developers were used as replenishers as such. The developing tank solution was used after the above starter was added at 20 ml per l of each developer.

The developer replenishing rate was 250 ml per $m^2$ of the sample according to the present invention.

Fixer composition

| Part A (for 38 l finish) | |
|---|---|
| Ammonium thiosulfate | 6080 g |
| Disodium ethylenediaminetetraacetate dihydrate | 0.76 g |
| Sodium sulfite | 456 g |
| Boric acid | 266 g |
| Sodium hydroxide | 190 g |
| Glacial acetic acid | 380 g |
| Water was added to make a total quantity of 9.5 l. | |
| **Part B (for 38 l finish)** | |
| Aluminum sulfate (as anhydrous salt) | 380 g |
| Sulfuric acid (50% by weight) | 228 g |
| Water was added to make a total quantity of 1.9 l. | |

Part mixing While stirring 20 l of water at 20° C. in a 50 liter tank, the above parts A and B were added in this order, and finally water and acetic acid was added to make a total quantity of 38 l and obtain a pH of 4.30 at 25° C. (the $Al^{3+}$ content per liter of the fixer was 58.5 mmol).

The fixer replenishing rate was 250 ml per $m^2$ of the sample according to the present invention.

Processing Each sample was processed with the above-described developers and fixer, using an automatic processing machine (SRX-502) in the 45-second processing mode, the developing temperature and fixing temperature being 35° C. and 33° C., respectively.

The sample thus obtained was evaluated as to scratching flaw resistance, roller marks and transportability as follows:

Scratching flaw resistance

After moisture conditioning at 23° C. temperature and 48% RH for 4 hours, the sample was scratched with a nylon brush bearing a 200 g weight on 12×14 cm area at a speed of 10 cm/sec, after which it was processed and macroscopically examined for the degree of flaws.

Evaluation criteria

A: No scratching flaws.

B: Almost no light blackened portions.

C: Light blackened portions seen, but not problematic for practical use.

D: Blackened portions clearly seen, problematic for practical use.

E: Numerous blackened lines seen, practical use impossible.

Roller marks

The unexposed sample film was processed as described above and then macroscopically evaluated as follows:

Evaluation criteria

A: No pressure spots.

B: Light spots seen in film margins, but not problematic for practical use.

C: Light spots seen in film center, but not problematic for practical use.

D: Dense spots seen in film margins, problematic for practical use.

E: Dense spots seen in film center and margins, practical use impossible.

Transportability

Using the automatic processing machine SRX-502 in the standard 45-second processing mode, 100 consecutive frames of the sample were transported, and the passage time was measured, to obtain the standard deviation. The value for σ, an index of transportability, increases as the dispersion of transport time widens.

The results are given in Table 1 below.

TABLE 1

| Sample No. | Emulsion | Base Material | Base Layer thickness | Scratching flaws | Roller marks | Transportability (σ) | Developer | Remark |
|---|---|---|---|---|---|---|---|---|
| 1 | H | PET | 180 | B | B | 0.045 | A | Comparative |
| 2 | I | PET | 180 | C | D | 0.045 | A | Comparative |
| 3 | I | PET | 100 | C | E | 0.320 | A | Comparative |
| 4 | I | PEN | 180 | C | E | 0.250 | A | Comparative |
| 5 | I | PEN | 120 | B | C | 0.112 | A | Inventive |
| 6 | I | PEN | 100 | B | B | 0.044 | A | Inventive |
| 7 | I | PEN | 70 | B | B | 0.045 | A | Inventive |
| 8 | I | PEN | 30 | B | C | 0.255 | A | Comparative |
| 9 | D | PEN | 100 | B | B | 0.045 | A | Inventive |
| 10 | E | PEN | 100 | B | B | 0.044 | A | Inventive |
| 11 | F | PEN | 100 | B | B | 0.045 | A | Inventive |
| 12 | G | PEN | 100 | B | B | 0.046 | A | Inventive |

PET: Polyethylene terephthalate
PEN: Polyethylene-2,6-naphthalate

From Table 1, it is seen that the scratches and roller marks formed in the samples using the emulsions D to I each comprising silver halide grains with high aspect ratio are considerably inhibited by the use of the support of the invention. When the emulsion I comprising silver halide grains having an aspect ratio of 1 was used, the scraches and roller marks are not formed, but in this case any benfit of the use of tabular grains such as high sensitivity and high sharpness of image cannot be obtained.

What is claimed is:

1. A silver halide photographic light-sensitive material comprising a support and a silver halide emulsion layer provided on the support, wherein at least 30% of the total projection area of the silver halide grains contained in said silver halide emulsion layer is occupied by the projection area of tabular silver halide grains having an aspect ratio of not less than 2; and said support comprises polyethylene-2, 6-naphthalate and has a thickness of 70 μm to 120 μm.

2. The material of claim 1, wherein said tabular silver halide grains have an average grain size of from 0.3 μm to 3.0 μm.

3. The material of claim 2, wherein said tabular grains have an average grain size of from 0.5 μm to 1.5 μm.

4. The material of claim 1, wherein said tabular grains have an average aspect ratio of from 2.5 to 20.0.

5. The material of claim 4, wherein said tabular grain have an average aspect ratio of from 3.0 to 10.0.

6. The material of claim 1, wherein at least 50 % of the total projection area of the silver halide grains contained in said silver halide emulsion layer is occupied by said tabular grains.

7. The material of claim 1, wherein said polyethylene-2, 6-naphthalate has a limiting viscosity number of not lower than 0.4.

8. The material of claim 7, wherein said polyethylene-2, 6-naphthalate has a limiting viscosity number of from 0.40 to 0.65.

9. The material of claim 8, wherein said polyethylene-2, 6-naphthalate has a crystallinity degree of from 35 % to 60 %.

10. The material of claim 1, wherein the composition of said tabular grains is silver bromide or silver iodobromide.

11. The material of claim 10, wherein the average silver iodide content of said tabular grains is not more than 5 mol %.

12. The material of claim 1, wherein said tabular grains each have silver iodide localized in a core.

13. The material of claim 1, wherein the surface resistivity of said support is not higher than 1014 Ω·cm.

14. The material of claim 1, wherein said polyethylene-2,6-naphthalate has a crystallinity degree of from 35 % to 60 %.

15. The material of claim 1, wherein the light-sensitive material has a cross-over cut layer.

* * * * *